US006976944B1

(12) United States Patent
Damasio

(10) Patent No.: US 6,976,944 B1
(45) Date of Patent: Dec. 20, 2005

(54) LOWER BACK STRETCHING APPARATUS

(76) Inventor: Robert M. Damasio, 212 County St., New Bedford, MA (US) 02740

( * ) Notice: Subject to any disclaimer, the term of this patent is extended or adjusted under 35 U.S.C. 154(b) by 13 days.

(21) Appl. No.: 10/621,724

(22) Filed: Jul. 18, 2003

(51) Int. Cl.[7] ..... A63B 26/00
(52) U.S. Cl. ..... 482/142; 482/112; 482/95
(58) Field of Search ..... 482/142, 907–908, 482/95, 112, 148; 606/241

(56) References Cited

U.S. PATENT DOCUMENTS 4,696,469 A * 9/1987 Elder ..... 482/137
4,867,142 A 9/1989 Jones
5,282,834 A 2/1994 Remy
5,376,060 A * 12/1994 Murray ..... 482/56
5,472,401 A * 12/1995 Rouillard et al. ..... 482/142
5,928,118 A 7/1999 Rosenthal

* cited by examiner

*Primary Examiner*—Stephen R. Crow
*Assistant Examiner*—L. Amerson
(74) *Attorney, Agent, or Firm*—John P. McGonagle

(57) ABSTRACT

An adjustable ramped and horizontal stretching bench device for relieving spinal and muscle conditions contributing to lower back pain. The stretching bench has a horizontal forward portion and a ramped rearward portion. The effective overall length of the stretching bench is adjustable to accommodate persons of different lengths and different relationships between body length and leg length. The angle between the forward portion and rearward portion is adjustable from zero degrees to forty-five degrees.

6 Claims, 6 Drawing Sheets

LOWER BACK STRETCHING APPARATUS

BACKGROUND OF THE INVENTION

This invention relates to stretching devices, and in particular, to a stretching apparatus for the lower back.

A significant portion of the population sustains injuries, often minor, which lead to lower back discomfort and pain. Many of these lower back injuries could be treated and/or avoided by improving the condition and strength of the lumbar region. Conditioning of the muscles of the lower back are most quickly attained by a regime of stretching exercises targeting the lumbar region.

There are many exercise machines in the prior art, some of which are specifically directed to the lower back region. However, most, if not all, of the prior art devices are limited in the range of stretching exercises available as well as limited to the size of the person able to use the device.

SUMMARY OF THE INVENTION

The present invention addresses the above problems by providing an adjustable ramped and horizontal stretching bench device for relieving spinal and muscle conditions contributing to lower back pain. The stretching bench of the present invention has a horizontal forward portion and a ramped rearward portion. The effective overall length of the stretching bench is adjustable to accommodate persons of different lengths and different relationships between body length and leg length. The angle between the forward portion and rearward portion is adjustable from 0 degrees to 45 degrees.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF INVENTION

Figure 1:
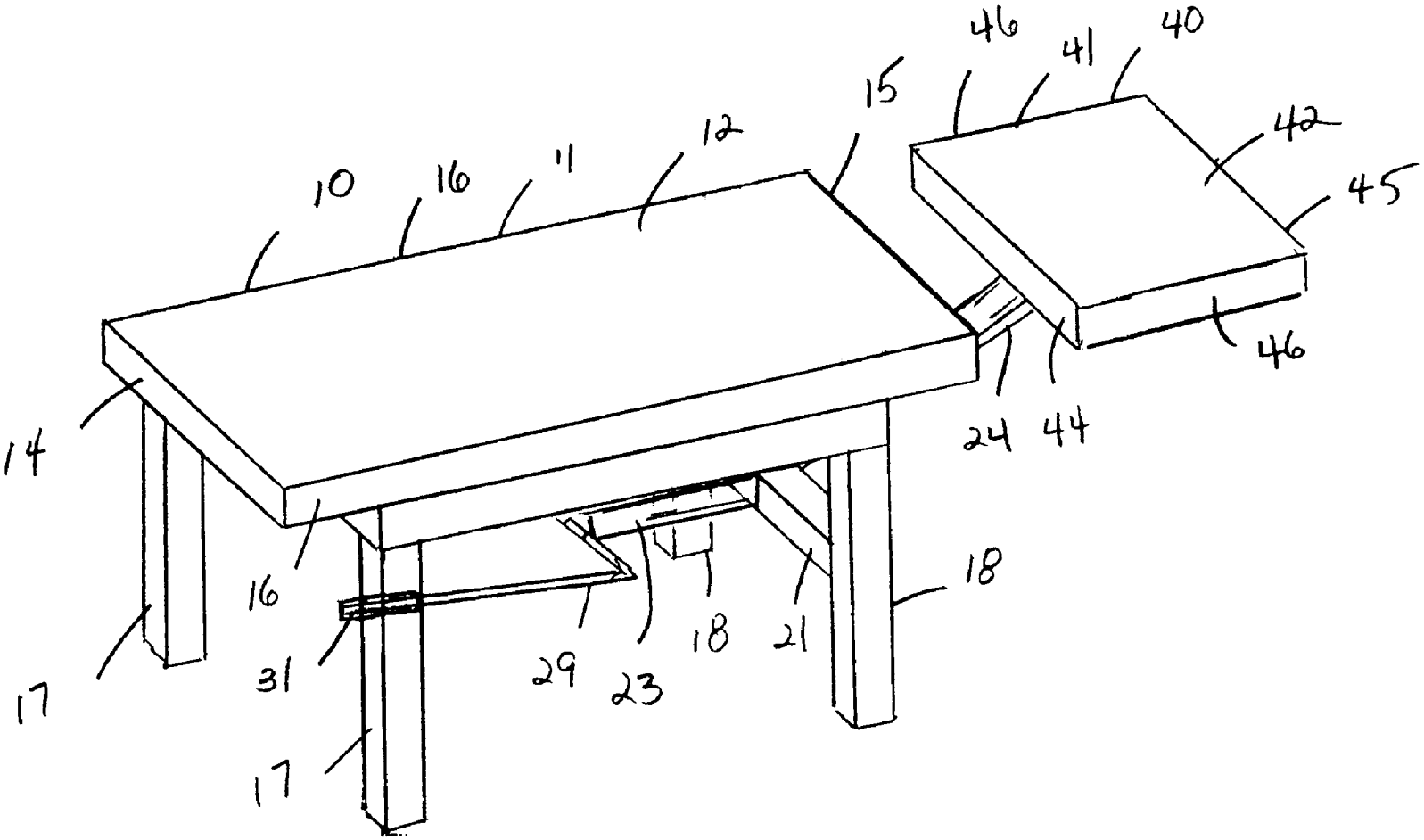
FIG. 1 is a top perspective view of the invention without leg holders.
Figure 2:
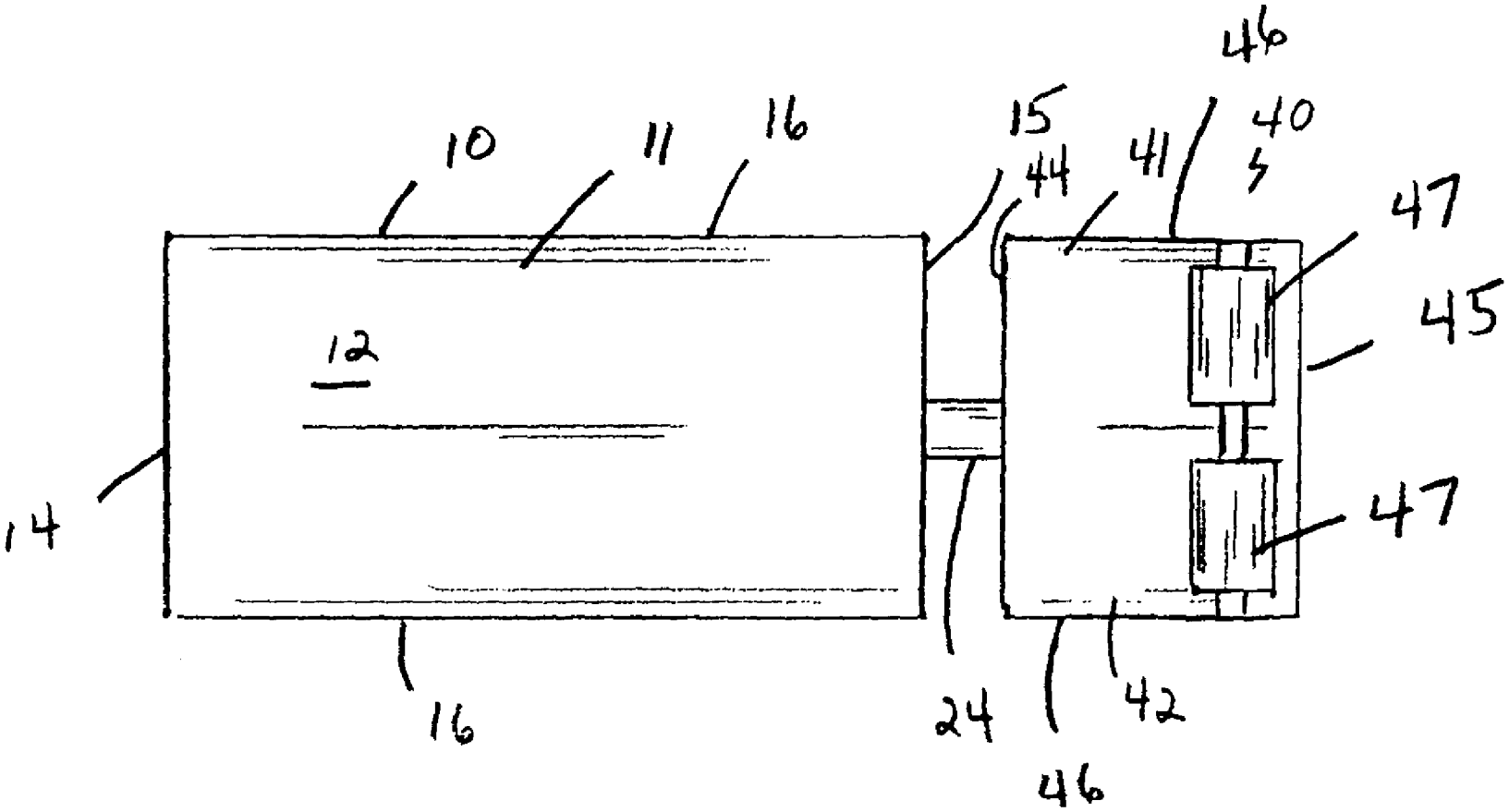
FIG. 2 is a top view with leg holders.
Figure 3:
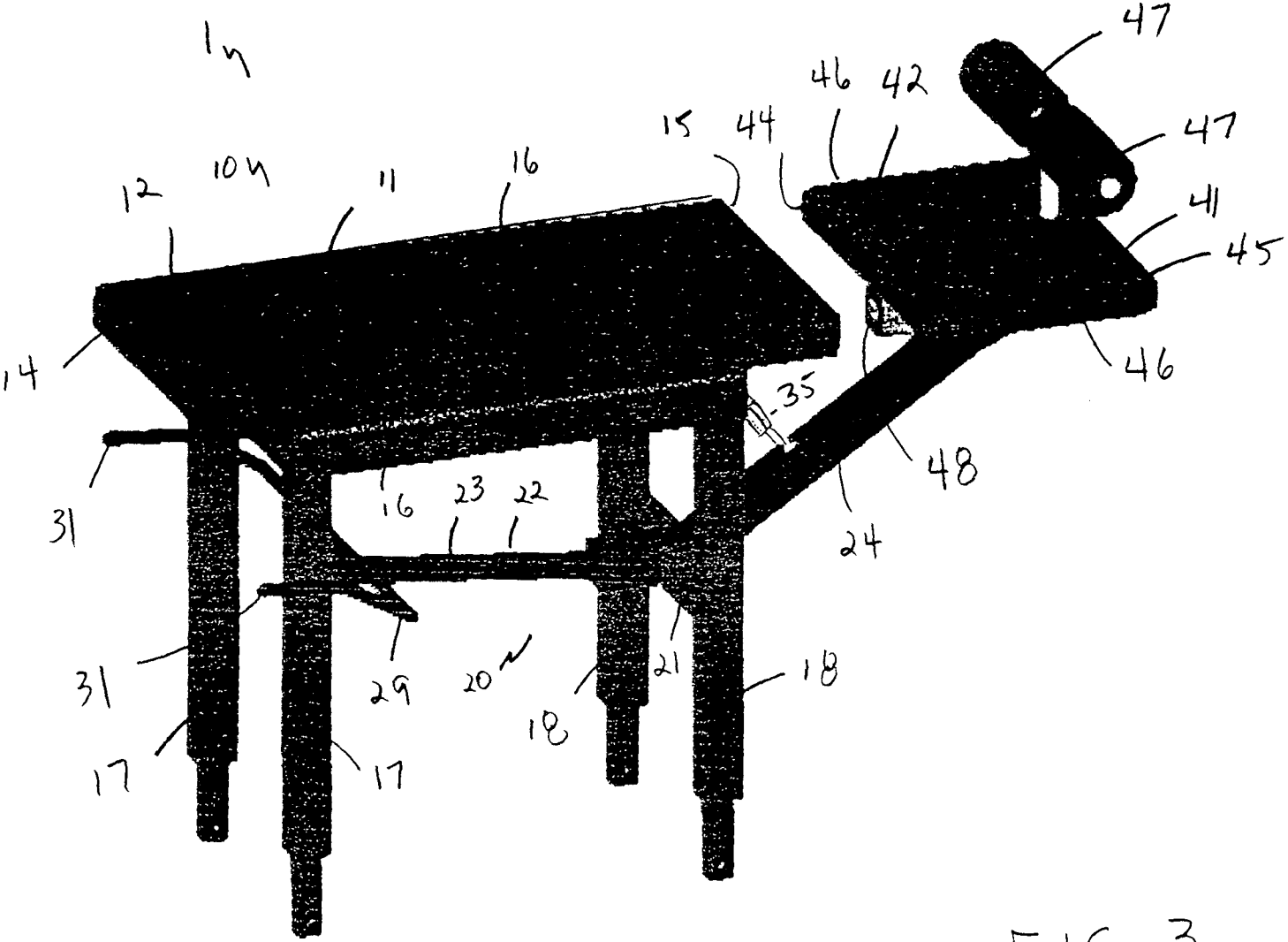
FIG. 3 is a top perspective view with leg holders.
Figure 4:
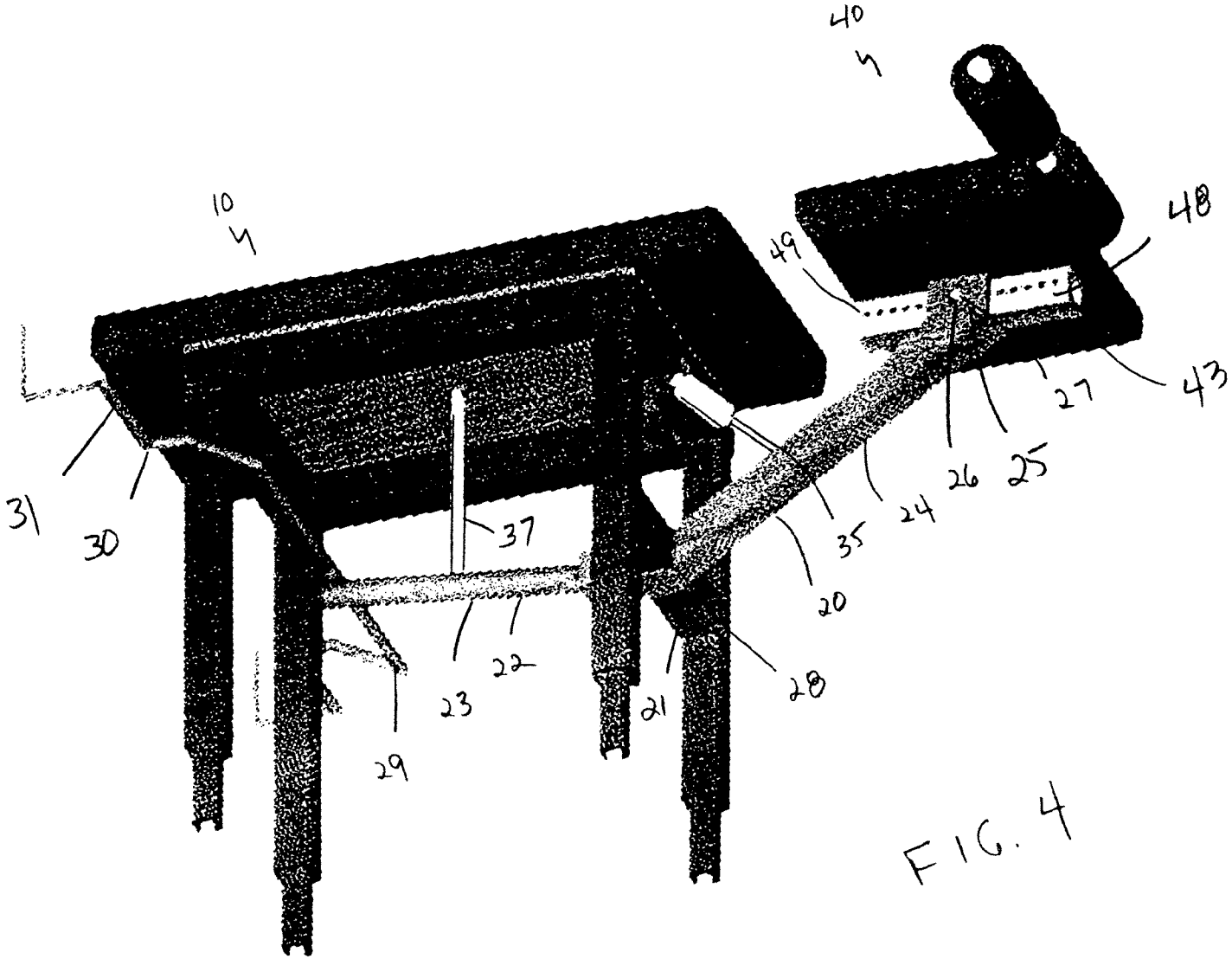
FIG. 4 is a bottom perspective view.
Figure 6:
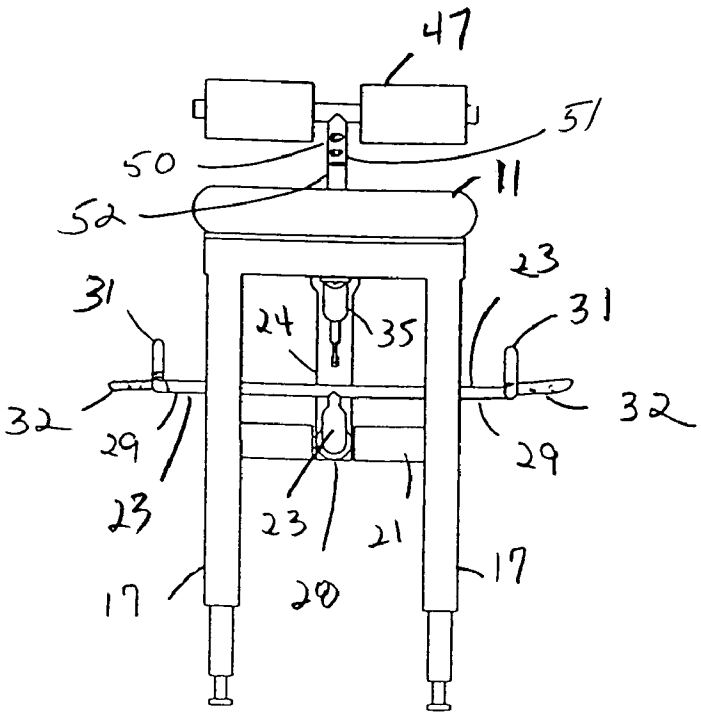
FIG. 6 is a front view.
Figure 5:
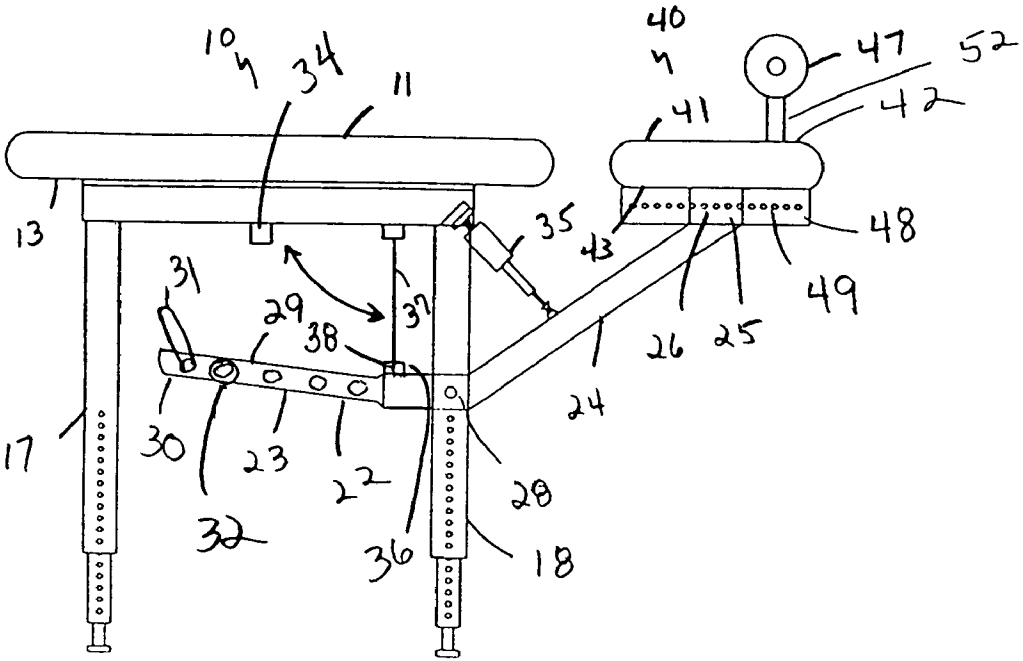
FIG. 5 is a side view.
Figure 8:
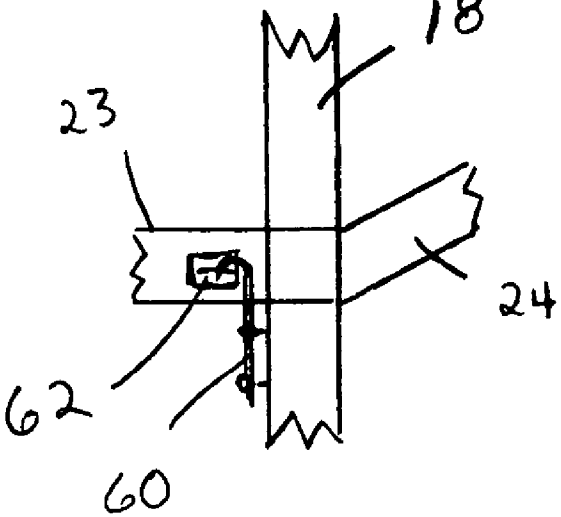
FIG. 8 is a side view thereof.
Figure 7:
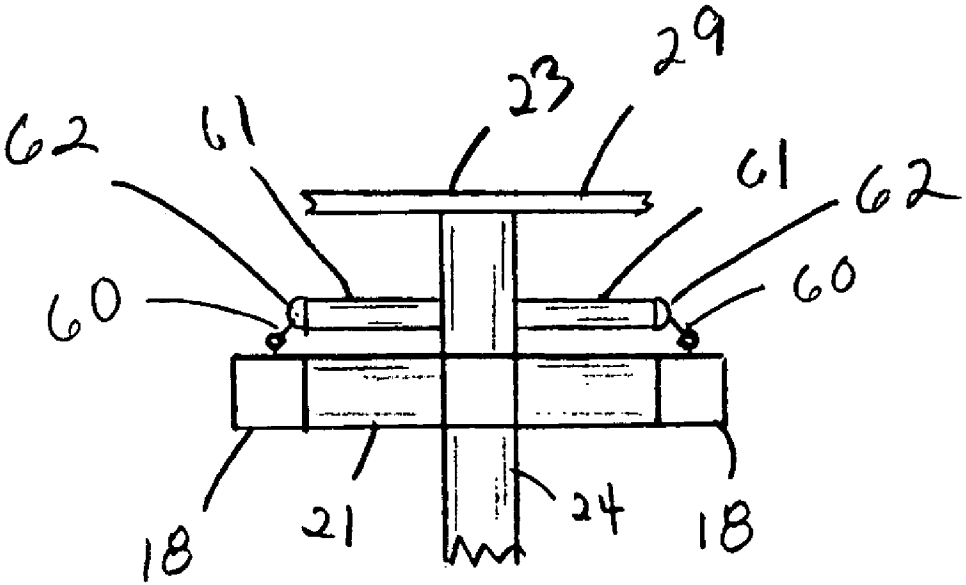
FIG. 7 is a top sectional view of the crank mechanism adjacent the cross bar.

Referring to the drawings in detail wherein like elements are indicated by like numerals, there is shown a lower back stretching apparatus 1 constructed according to the principles of the present invention. The apparatus is comprised of a padded, waist-high bench 1 having a horizontal forward portion 10 and a pivotable rearward portion 40. The forward portion 10 is adapted to support a prone upper torso of a user. The rearward portion 40 is adapted to support the legs of a user. The forward portion 10 and rearward portion 40 are interconnected by a crank mechanism 20 adapted to pivot the rearward portion 40 from a zero degree horizontal position through a forty-five degree downward and rearward tilted position.

The forward portion 10 is comprised of a generally flat, rectangular, horizontal, padded element 11 having an upper surface 12, an opposite lower surface 13, a front end 14, a rear end 15, and two opposite sides 16 interconnecting the front end 14 with the rear end 15. The front end 14 and rear end 15 define a front portion longitudinal axis. The forward portion padded element upper surface 12 is adapted to support the upper torso of a user. The forward portion 10 is further comprised of four vertical support legs attached to the padded element lower surface 13. The legs are individually length-adjustable. Two front legs 17 are attached near to the element front end 14, one each near to each opposite side 16. Two rear legs 18 are attached near to the element rear end 15, one each near to each opposite side 16. The legs 17, 18 may be vertically adjustable so that a user can adjust the height of the forward portion.

The rearward portion 40 is comprised of a generally flat, rectangular, horizontal, padded element 41 having an upper surface 42, an opposite lower surface 43, a front end 44, a rear end 45, and two opposite sides 46 interconnecting the front end 44 with the rear end 45. The front end 44 and rear end 45 define a rearward portion longitudinal axis. The rearward portion padded element upper surface 42 is adapted to support the legs of a user. The forward portion front end 14 and rearward portion rear end 45 define a bench 1 longitudinal axis. Two round leg holders 47 are mounted on the rearward portion element upper surface 42 near to the rearward portion rear end 45. The leg holders 47 are adjustable along an axis perpendicular to a rearward portion padded element upper surface plane. A spring loaded button 50 protruded through a select hole 51 formed in a vertical telescoping support bar 52 enables the leg holders to be adjusted closer or farther from the padded element upper surface This enables a user to have the backs of his legs removably gripped during a stretching procedure. An elongated, hollow support bar 48 is attached longitudinally to the rearward portion lower surface 43, said support bar 48 having a longitudinal axis parallel to the longitudinal axis of the rearward portion 40. The support bar 48 has a row of apertures 49 along each bar side. Different sized padded elements 41 may be attached to the elongated, hollow support bar 48 thereby servicing exerciser of different sizes.

The rearward portion 40 is attached to a crank mechanism 20 adapted to pivot the ramped rearward portion from a zero degree horizontal position through a forty-five degree downward and rearward tilted position. The crank mechanism 20 is comprised of a support cross-bar 21 attached to the two rear support legs 18 of the forward portion 10. The crank mechanism 20 is further comprised of an elongated crank lever 22 pivotally attached to the support cross-bar 21. The crank lever 22 has a forward portion 23 in front of the cross-bar 21 and a rearward portion 24 to the rear of the cross-bar 21. The crank lever forward portion 23 terminates in a Y-shaped element 29 with each element end 30 terminating in a hand grip 31 adjustably positioned along the forward portion padded element sides 16. A secondary set of hand grips 32 are adjustably positioned laterally along the crank lever forward portions 23. The crank lever rearward portion 24 terminates in a U-shaped element 25 having apertures 26 formed along its sides. The U-shaped element 25 is adapted to fit about the rearward portion support bar 48 wherein the U-shaped apertures 26 are aligned with the support bar apertures 49. An elongated removable pin 27 is provided for joining the U-shaped element 25 and the support bar 48 together. The elongated pin 27 is removably attached through the U-shaped element apertures 26 and support bar apertures 49.

The crank lever 22 has a center section 28 rotatably attached to the support cross-bar 21. A damper piston 35 interconnects the padded element rear end 15 with the crank mechanism rearward portion 24.

Pulling the hand grips 31 up translates about the support cross-bar 21 a downward pull on the rearward portion support bar 48 causing the rearward portion padded element 41 to move downward as the crank lever rearward portion 24 pivots downward about the support cross-bar 21. Pushing the hand grips 31 downward translates about the support cross-bar 21 an upward push on the rearward portion support bar 48 causing the rearward portion padded element 41 to move upward.

Adjustments in the effective length of the apparatus 1, i.e., separation between forward portion 10 and rearward portion 40, may be made by changing the pin 27 placement in the U-shaped element apertures 26 and support bar apertures 49. A spring-loaded, pivotable vertical locking bar 37 may be attached to the forward portion padded element lower surface 13 for engagement with the crank mechanism crank lever forward portion 23. The locking bar 37 is adapted to hold the crank lever 22 in position wherein the rearward portion 40 is in a full horizontal position. A holder 36 mounted on the crank lever 22 seats the locking bar 37 in place. When the exerciser is in position and the invention ready to be used, the locking bar 37 is released from the crank lever holder 36. The spring-loaded locking bar 37 springs forward up to a horizontal position where it engages another holder 34 attached to the forward portion padded element lower surface 13. Bottom prongs 38 on the locking bar 37 will hold the crank lever forward portion 23 in a desired position so that the user may easily and safely position himself on the exercise apparatus 1.

In another embodiment of the invention a hook element 60 is rotatably attached to each rear support leg 18. A laterally protruding bar 61 is attached to each side of the crank mechanism forward portion 23 near to the cross bar 21. Each laterally protruding bar 61 terminates in a half-ring element 62. Each hook element 60 is adapted to engage a half-ring element 62. This provides an additional safety element over and above the locking bar 37. When the user desired to use the invention 1, the hooks 60 are disengaged from the half-rings 62 and rotated away from the lateral bars 61.

It is understood that the above-described embodiment is merely illustrative of the application. The Other embodiments may be readily devised by those skilled in the art which will embody the principles of the invention and fall within the spirit and scope thereof.

I claim:

1. A lower back stretching apparatus comprising:

a padded, waist-high bench comprising:

a horizontal forward portion adapted to support a user's prone upper torso, wherein the forward portion is comprised of:

a generally flat, rectangular, horizontal, padded element having an upper surface, an opposite lower surface, a front end, a rear end, and two opposite sides interconnecting the front end with the rear end, said front end and rear end defining a front portion longitudinal axis;

four vertical support legs attached to the padded element lower surface, two of which vertical legs are front legs attached near to the element front end, one each near to each opposite side, and two of which vertical legs are rear legs attached near to the element rear end, one each near to each opposite side;

a pivotable rearward portion adapted to support a user's legs, wherein the rearward portion is comprised of:

a generally flat, rectangular, horizontal, padded element having an upper surface, an opposite lower surface, a front end, a rear end, and two opposite sides interconnecting the front end with the rear end, said front end and rear end defining a rearward portion longitudinal axis;

two leg holders mounted on the rearward portion element upper surface near to the rearward portion rear end, said holders adapted to removably grip a pair of user legs during a stretching procedure;

an elongated, hollow support bar attached longitudinally to the rearward portion lower surface, said support bar having a longitudinal axis parallel to the longitudinal axis of the rearward portion, said support bar having a row of apertures along a bar side;

a crank mechanism interconnecting the forward portion and the rearward portion, said crank mechanism adapted to pivot the rearward portion from a zero degree horizontal position through a forty-five degree downward and rearward tilted position, wherein the crank mechanism is comprised of:

a support cross-bar attached to the two rear support legs of the forward portion;

an elongated crank lever pivotally attached to the support cross-bar, said crank lever comprising:

a forward portion in front of the support cross-bar, said crank lever forward portion terminating in a Y-shaped element having two element ends, each said element end terminating in a hand grip positioned to the forward portion padded element sides;

a rearward portion to the rear of the support cross-bar, said crank lever rearward portion terminating in a U-shaped element having apertures formed along its sides, said U-shaped element adapted to fit about the rearward portion support bar, wherein the U-shaped apertures are aligned with the support bar apertures;

a center section rotatably attached to the support cross-bar; an elongated removable pin adapted for joining the U-shaped element and the support bar together, said elongated pin adapted for removable attachment through the U-shaped element apertures and support bar apertures;

a damper piston interconnecting the forward portion rear end with the crank mechanism rearward portion.

2. A stretching apparatus as recited in claim 1, wherein: said vertical support legs are vertically adjustable.

3. A stretching apparatus as recited in claim 2, wherein: said leg holders are adjustable along an axis perpendicular to a rearward portion padded element upper surface plane;

wherein a spring loaded button protruding through a select hole formed in a vertical telescoping support bar enables the leg holders to be adjusted closer or farther from the padded element upper surface.

4. A stretching apparatus as recited in claim 3, further comprising:

a spring-loaded, pivotable vertical locking bar attached to the forward portion padded element lower surface and adapted for engagement with the crank mechanism crank lever forward portion, said locking bar is adapted to hold the crank lever in position wherein the rearward portion is in a full horizontal position;

a holder mounted on the crank lever adapted for removably seating the locking bar in place;

a second holder attached to the forward portion padded element lower surface adapted for engaging the spring-loaded locking bar.

5. A stretching apparatus as recited in claim 4, further comprising:

a hook element rotatably attached to each rear support leg;

a laterally protruding bar attached to each side of the crank mechanism forward portion near to the cross bar, each laterally protruding bar terminating in a half-ring element;

wherein each hook element is adapted to engage a half-ring element.

6. A stretching apparatus as recited in claim 5, further comprising:

a plurality of bottom prongs on the locking bar adapted to engage said crank lever holder and said second holder.

* * * * *